US007068807B2

(12) United States Patent
Kobayashi

(10) Patent No.: US 7,068,807 B2
(45) Date of Patent: Jun. 27, 2006

(54) SPEAKER DEVICE

(75) Inventor: Shinji Kobayashi, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/991,337

(22) Filed: Nov. 17, 2004

(65) Prior Publication Data

US 2005/0129266 A1 Jun. 16, 2005

(30) Foreign Application Priority Data

Nov. 17, 2003 (JP) ..... 2003-387145

(51) Int. Cl.
*H04R 25/00* (2006.01)

(52) U.S. Cl. ..... 381/412; 381/421; 381/420

(58) Field of Classification Search ..... 381/395, 381/400, 401, 403, 405, 407, 410, 412, 420, 381/421

See application file for complete search history.

(56) References Cited

U.S. PATENT DOCUMENTS 4,661,973 A * 4/1987 Takahashi ..... 379/194
5,062,140 A * 10/1991 Inanaga et al. ..... 381/399
5,402,503 A * 3/1995 Prokisch ..... 381/421
5,461,677 A * 10/1995 Raj et al. ..... 381/422
6,269,168 B1 * 7/2001 Tagami ..... 381/412
6,574,346 B1 * 6/2003 Tanaka ..... 381/421
2005/0105756 A1 5/2005 Kobayashi et al.

FOREIGN PATENT DOCUMENTS

EP 0581129 A1 * 2/1994
JP 59062299 A * 4/1984
JP 03083496 * 4/1991

* cited by examiner

*Primary Examiner*—Suhan Ni
*Assistant Examiner*—Dionne Pendleton
(74) *Attorney, Agent, or Firm*—Wolf, Greenfield & Sacks, P.C.

(57) ABSTRACT

To realize a speaker device capable of significantly improving sound quality with a simple construction. The speaker device applies electromagnetic force to a voice coil based on a supplied audio signal, and generates a sound wave according to the audio signal by vibrating a vibratory plate fixed to the voice coil.

1 Claim, 3 Drawing Sheets

SPEAKER DEVICE

BACKGROUND OF THE INVENTION

1. Field of the Invention

This invention relates to a speaker device and is suitably applied to a cone speaker, for example.

2. Description of the Related Art

Cone speakers are classified into two types depending on the type of magnetic circuit: a cone speaker (hereinafter, referred to as external magnet speaker, simply) in which a ring magnet is provided so as to surround a voice coil; and an internal magnet type cone speaker (hereinafter, referred to as internal magnet speaker, simply) with a cylindrical magnet having a voice coil wounded thereon.

As shown in FIG. 1, an external magnet speaker 1 has a conic cone vibratory plate 2 with its end opened. The outer circumference of the cone vibratory plate 2 is supported via a gasket 4 by an edge 3A formed in a frame 3. In addition, the opening of its inner circumference is supported by a damper 5 attached to the frame 3, so that the cone vibratory plate 2 is movable forwards and backwards to the frame 3.

In addition, the opening of the cone vibratory plate 2 is fixed to a cylindrical voice coil bobbin 7 having wounded thereon a voice coil 6 comprising a lead line. In addition, above the opening, a hemisphere head cap 8 is attached with its projecting side facing outwards so as to cover the opening, thereby preventing deformation of the cone vibratory plate 2 in the diameter direction and preventing dusts from entering inside.

In addition, to the bottom of the frame 3, a magnetic circuit (hereinafter, referred to as an external magnet type magnetic circuit) 9 for vibrating the cone vibratory plate 2 forwards and backwards is fixed. This external magnet type magnetic circuit 9 is composed of a disk yoke 10 with a column pole piece 10A provided at the center thereon, a toric magnet 11 fixed so as to surround the outer circumference of the yoke 10, and a toric plate 12 laminated and fixed onto the magnet 11.

When the external magnet type magnetic circuit 9 is attached to the frame 3 so that the top of the plate 12 is fixed to the bottom of the frame 3, the voice coil bobbin 7 having wounded thereon the voice coil 6 is kept in a contactless manner in a magnetic gap g1 formed between the pole piece 10A and the plate 12.

Therefore, in the external magnet speaker 1, when electromagnetic force is applied to the voice coil 6 according to applied current based on an audio signal externally supplied, the voice coil 6 and the magnet 11 attract and repel each other, thereby generating a sound wave according to the audio signal by vibrating the cone vibratory plate 2 forwards and backwards.

In addition, in FIG. 2 where the same reference numerals are applied to parts corresponding to those of FIG. 1, an internal magnet speaker 20 is identical to the external magnet speaker 1 (FIG. 1), expect for the shapes, constructions and arrangement of a yoke and a magnet composing a magnetic circuit.

A magnetic circuit (hereinafter, referred to as internal magnet type magnetic circuit) 21 in this internal magnet speaker 20 has a pot yoke 22. A column magnet 24 is fixed at the center on the bottom inside the yoke 22 and a disk center pole 23 is laminated and fixed on the magnet 24.

When the internal magnet type magnetic circuit 21 is fixed to the frame 3 so that the top of the yoke 22 is fixed to the bottom of the frame 3, a voice coil bobbin 7 having a voice coil 6 wounded thereon is kept in a contactless manner in a magnetic gap g2 formed between the center pole 23 and the yoke 22.

In this internal magnet speaker 20, when electromagnetic force is applied to the voice coil 6 according to applied current based on an audio signal external supplied, the voice coil 6 and the magnet 24 attract and repel each other, thereby generating a sound wave according to the audio signal by vibrating the cone vibratory plate 2 forwards and backwards.

In such two types of cone speakers 1 and 20, the internal magnet speaker 20 was conventionally used. However, since the pot internal magnet type magnetic circuit 21 has a very long depth and entirely has a squat box shape, the external magnet speaker 1 which is can be made relatively plane and slim is generally used now. (Patent Reference 1: Japanese Patent Laid-Open No. 10-304493; and Patent Reference 2: Japanese Patent Laid-Open No. 11-55788)

By the way, to improve sound quality, such an external magnet speaker 1 generally adopts a technique to further increase magnetic flux density generated between the voice coil 6 and the magnet 11 of the external magnet type magnetic circuit 9.

For this purpose, in the external magnet type magnetic circuit 9, the diameter of the ferrite toric magnet 11 should be made larger, or the material of the magnet 11 should be changed to neodymium material capable of obtaining relatively high magnetic flux density or composite material including the neodymium material.

However, in the case of making the diameter of the magnet 11 larger, the external magnet type magnetic circuit 9 becomes large, and the entire speaker device becomes large accordingly. Therefore, a problem arises in that it is difficult to attach the speaker device at an installation place. On the other hand, in the case of using a rare metal magnet having a very high scarcity value like the neodymium material, another problem arises in that the speaker device is expensive and its mass production may not be realized.

Further, the external magnet type magnetic circuit 9 of the external magnet speaker 1 may leak magnet to the outside due to its construction. Therefore, if a monitor or a display exists near this speaker, colors may be changed on a display screen. Therefore, such magnetic leaks should be considered, which causes a trouble.

SUMMARY OF THE INVENTION

This invention has been made in view of foregoing and intends to provide a speaker device capable of significantly improving sound quality with a simple construction.

To solve the problems, this invention provides a speaker device for applying electromagnetic force to a voice coil based on an audio signal supplied and generating a sound wave according to the audio signal by vibrating a vibratory plate fixed to the voice coil, with an electromagnetic generation means comprising: a pole piece provided at the center of a yoke; a first annular magnet fixed onto the yoke so as to surround the pole piece; and an annular plate laminated on the first magnet. The electromagnetic generation means further comprises a second magnet of a prescribed thickness which is laminated on the pole piece and is magnetized in an opposite direction to the first magnet, and the voice coil is kept in a contactless manner in a magnetic gap formed between the plate, and the pole piece and the second magnet.

As a result, this speaker device can significantly increase magnetic flux density generated in the magnetic gap by extending the magnetic gap by the thickness of the second magnet, so that the vibratory plate can be stably controlled by increasing the linear part of the vibration property of the vibratory plate, thus making it possible to realize a speaker device capable of significantly improving sound quality with a simple construction.

The nature, principle and utility of the invention will become more apparent from the following detailed description when read in conjunction with the accompanying drawings in which like parts are designated by like reference numerals or characters.

DETAILED DESCIRPTION OF THE EMBODIMENT

Preferred embodiments of this invention will be hereinafter described with reference to the accompanying drawings:

(1) Construction of External Magnet Speaker According to this Embodiment

Figure 1:
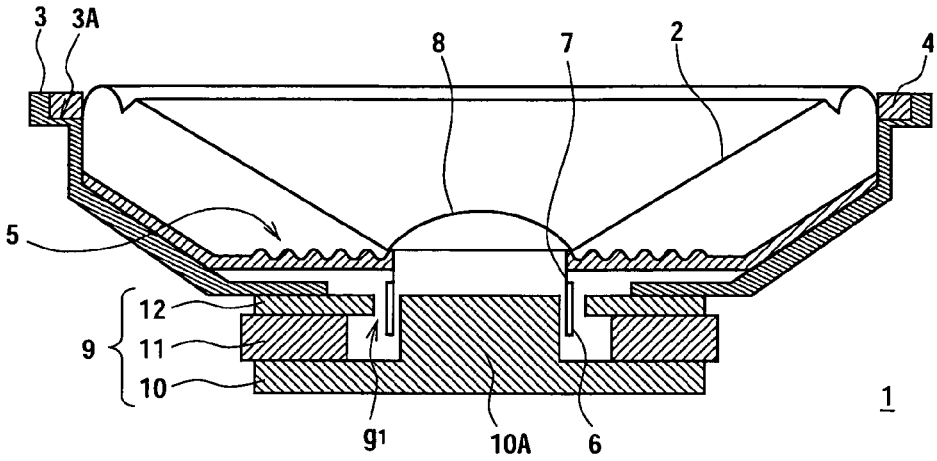
FIG. 1 (RELATED ART)
FIG. 1 is a schematic perspective view showing a constriction of a conventional external magnet speaker.
Figure 2:
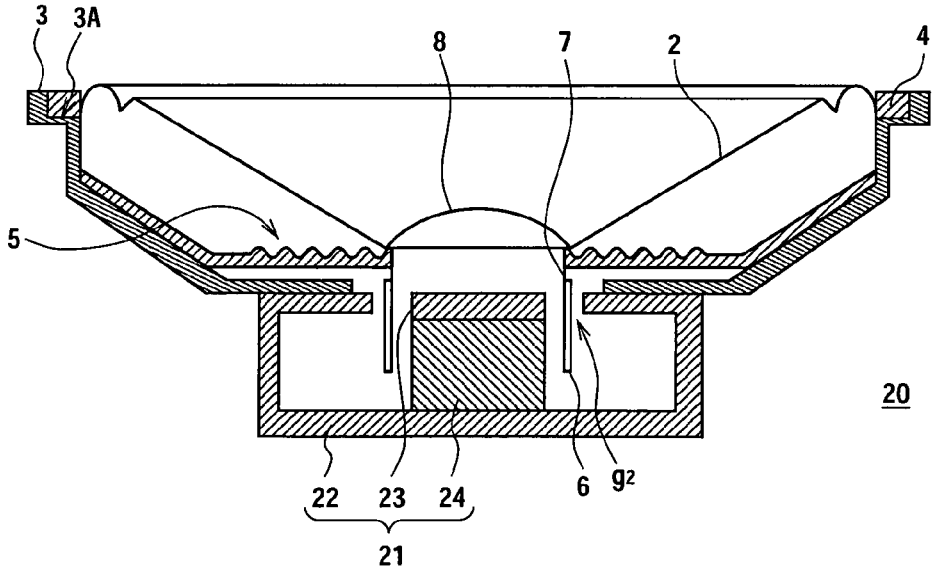
FIG. 2 (RELATED ART)
FIG. 2 is a schematic perspective view showing a construction of a conventional internal magnet speaker.
Figure 3:
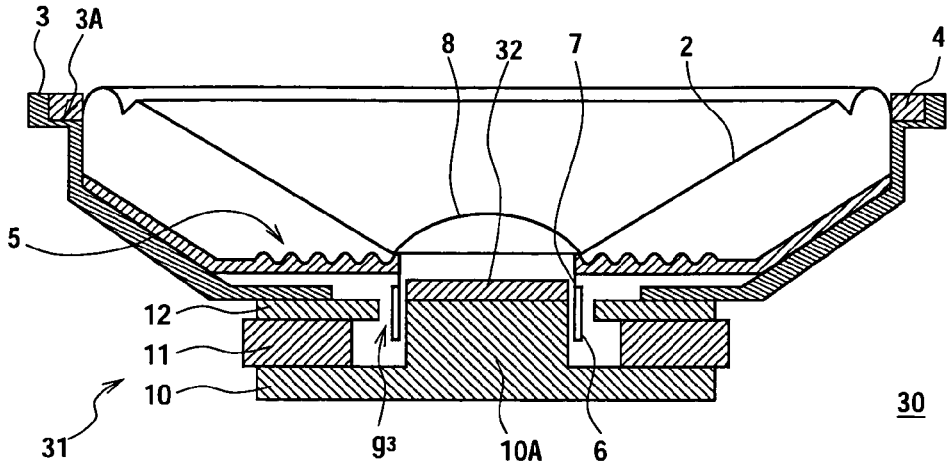
FIG. 3 is a schematic perspective view showing a construction of an external magnet speaker according to this embodiment.

Referring to FIG. 3 where the same reference numerals are applied to parts corresponding to those of FIG. 1, reference numeral 30 shows a cone speaker (that is, external magnet speaker) with an external magnet type magnetic circuit according to this embodiment. This speaker is identical to the above-described conventional external magnet speaker 1 (FIG. 1), excepting that a disk magnet (hereinafter, referred to as sub magnet) 32 made of rare metal such as neodymium material of the same diameter as a pole piece 10A is laminated and fixed on a pole piece 10A provided at the center of a yoke 10 of an external magnet type magnetic circuit 31.

In this external magnet type magnetic circuit 31, the top of the pole piece 10A provided at the center of the yoke 10 is level with the top of the magnet 11 placed on the plate 12 laminated on the external circumference of the yoke 10. And the sub magnet 32 is laminated on the pole piece 10A so as to be higher than the plate 12 by its thickness.

Figure 4:
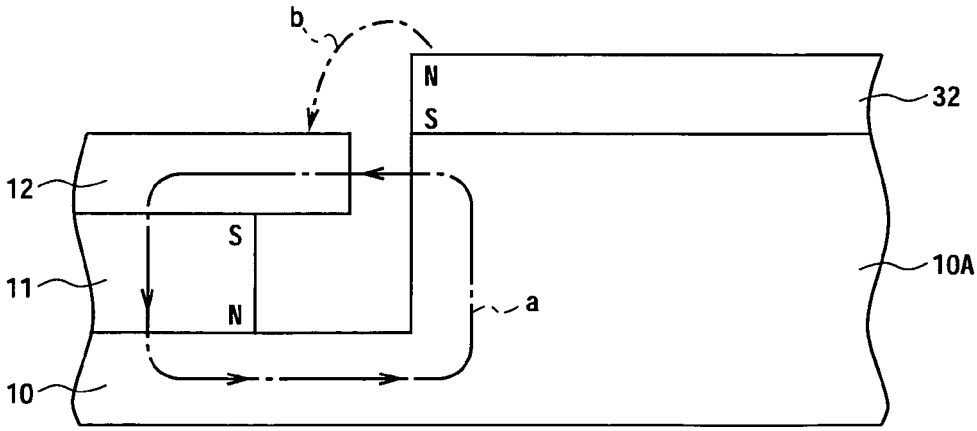
FIG. 4 is a schematic diagram explaining a magnetic flow in an external magnet type magnetic circuit of the external magnet speaker of FIG. 3.

This sub magnet 32 is magnetized in an opposite direction to the annular magnet 11 which is fixed so as to surround the external circumference of the yoke 10. As shown in FIG. 4, in a case where the magnet 11 is magnetized with polar S, N, the sub magnet 32 is magnetized with polar N, S.

As a result, in addition to a magnetic flow (direction of a magnetic line shown by an arrow a) on the magnet 11, the pole piece 10A, and the plate 12, a magnetic flow (direction of a magnetic line shown by an arrow b) from the sub magnet 32 to the pole piece 10A via the plate 12 is added, thereby extending a magnetic gap g3 by the height of the sub magnet 32, thus extending an area where the voice coil 6 is controlled by the magnetic flux.

That is, in this external magnet type magnetic circuit 31, when signal current according to an audio signal is externally supplied, secondary current according to the signal current is induced by magnetic coupling, thereby applying driving force according to the signal current to the voice coil 6 under the Fleming's left-hand rule.

The driving force to be applied to the voice coil 6 is represented by a product of the secondary current induced in the voice coil 6, magnetic flux density generated in the magnetic gap g3 formed between the pole piece 10A, and the sub magnet 32 and the plate 12, and the length of the voice coil 6 existing in the magnetic gap g3.

Out of these, the magnetic flux density generated in the magnetic gap g3 and the length of the voice coil 6 existing in the magnetic gap g3 are fixed. Therefore, the driving force to be applied to the voice coil 6 is proportional to the secondary current induced in the voice coil 6. Then the secondary current induced in the voice coil 6 is proportional to a product of signal current flowing between the pole piece 10A and the plate 12 and the size of the plate 12 facing the pole piece 10A.

In this connection, the sub magnet 32 is designed to be laminated on the pole piece 10A, and its thickness is determined so as to just extend an area where the voice coil 6 is controlled by the magnetic flux. Therefore, not a special technique but an existing technique can be used for magnetization, that is, this simple technique is an advantage.

(2) Operation and Effects of this Embodiment

According to the above configuration, in the external magnet speaker 30, when an audio signal is supplied, a magnetic field according to applied current based on the audio signal is generated in the magnetic gap g3 formed between the sub magnet 32 and the pole piece 10A, and the plate 12 in the external magnet type magnetic circuit 31, thus generating a sound wave according to the audio signal by vibrating the cone vibratory plate 2 forwards and backwards in accordance with attraction and repelling of the voice coil 6 existing in the magnetic gap g3.

At this time, since the magnetic gap g3 is extended by the height of the sub magnet 32, an area where the voice coil 6 is controlled by the magnetic flux is extended and an area to be controlled by supporting (suspension) of the frame 3 via the cone vibratory plate 2 above the pole piece 10A is reduced.

As a result, in the external magnet speaker 30, even if the voice coil 6 is positioned above the pole piece 10A and is away from the plate 12 in audio playback, the magnetic flux density generated in the magnetic gap g3 can be further increased by controlling the height of the sub magnet 32 by the magnetic flux, thus being capable of stably controlling the cone vibratory plate 2 by increasing the linear part of the vibration property of the cone vibratory plate 2.

In this connection, conventionally, when the voice coil 6 is positioned above the pole piece 10A, the control by the magnetic flux deteriorates and control by supporting of the frame 3 via the cone vibratory plate 2 is performed, which makes the vibration property of the cone vibratory plate 2 nonlinear and thus makes stable control difficult.

According to the above configuration, in this external magnet speaker 1, the sub magnet 32 for generating reverse magnetic field with the magnet 11 is laminated and fixed onto the pole piece 10A of the external magnet type magnetic circuit 31, so as to extend the magnetic gap g3 by the thickness of the sub magnet 32, thereby further increasing the magnetic flux density generated in the magnetic gap g3. Therefore, the cone vibratory plane 2 can be stably controlled by increasing the linear part of the vibration property of the cone vibratory plate 2, thus making it possible to realize an external magnet speaker 30 capable of significantly improving sound quality with a simple construction.

(3) Other embodiments

Note that the above embodiment has described a case where this invention is applied to the external magnet speaker 30 constructed as shown in FIG. 3. This invention, however, is not limited to this and can be widely applied to speaker devices with an external magnet type magnetic circuit (electromagnetic force generation means) out of speaker devices which apply electromagnetic force to a voice coil based on a supplied audio signal and generate a sound wave according to the audio signal by vibrating a vibratory plate fixed to the voice coil.

Figure 5:
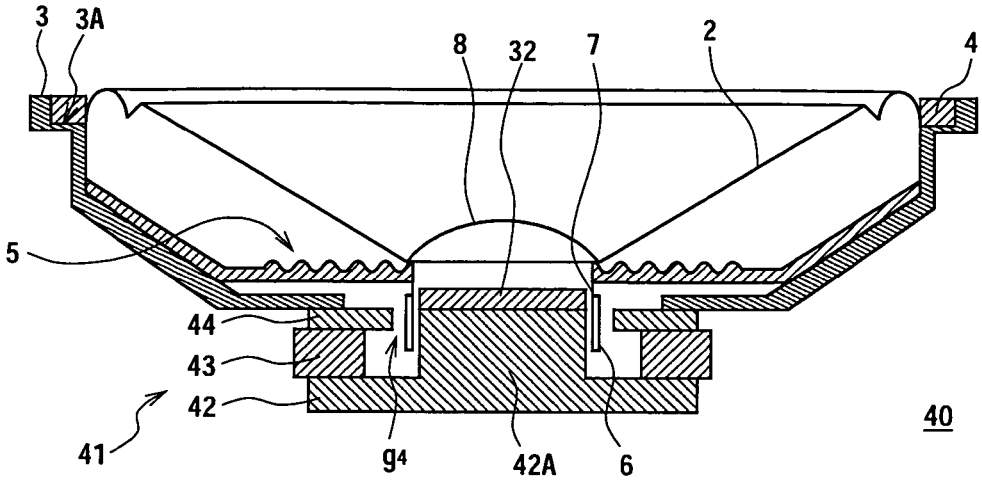
FIG. 5 is a schematic perspective view showing a construction of an external magnet speaker according to another embodiment.

For example, as shown in FIG. 5 where the same reference numerals are applied to parts corresponding to those of FIG. 3, an external magnet speaker 40 is identical to the external magnet speaker 30 (FIG. 3) according to the above embodiment, except for the construction of an external magnet type magnetic circuit 41. In this external magnet type magnetic circuit 41, the top of a pole piece 42A provided at the center of a yoke 42 is designed to be level with that of a plate 44 placed on a magnet 43 laminated on the external circumference of the yoke 42. Then a sub magnet 32 is laminated on the pole piece 42A so as to be higher by its thickness.

Compared with the above-described external magnet type magnetic circuit 31 (FIG. 3), the magnet 43 and the plate 44 laminated on the pole piece 42 in this external magnet type magnetic circuit 41 have smaller diameters. As a result, compared with the a general external magnet speaker 1 (FIG. 1) which does not have a sub magnet 32, the external magnet type magnetic circuit 41 can be further downsized. Specifically, it can be very effective for limited installation space, like stereo systems for vehicles.

Further, according to this embodiment as described above, the external magnet type magnetic circuit (electromagnetic force generation means) 31 of the external magnet speaker 30 is composed of the pole piece 10A provided at the center of the yoke 10, the annular magnet (first magnet) 11 fixed onto the yoke 10 so as to surround the pole piece 10A, the annular plate 12 laminated on the magnet (first magnet) 11, and a sub magnet (second magnet) 32 of a prescribed thickness which is laminated on the pole piece 10A and is magnetized in an opposite direction to the magnet (first magnet) 11, and the voice coil 6 is kept in a contactless manner in the magnetic gap g3 formed between the plate 12, and the pole piece 10A and the sub magnet (second magnet) 32. This invention, however, is not limited to this and can be applied to external magnet speakers having other various constructions, provided that they can further increase magnetic flux density which is generated in a magnetic gap g3 by extending the magnetic gap g3 by the thickness of a magnet (second magnet) 32.

Furthermore, the above-described embodiment has described a case where the magnet 11 is made of general ferrite magnetic material and the sub magnet 32 is made of rare metal magnetic material having a very high scarcity value, like neodymium material. Alternatively, other materials having stronger magnetism than the magnet 11 can be applied, provided that they have thickness so as to just extend an area where the voice coil 6 is controlled by magnetic flux and can adopt a normal magnetization technique.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. A speaker device for applying electromagnetic force to a voice coil based on an audio signal supplied, and generating a sound wave according to the audio signal by vibrating a vibratory plate fixed to the voice coil, comprising:

electromagnetic force generation means comprising:

a pole piece placed at a center of a yoke;

a first annular magnet fixed onto the yoke so as to surround the pole piece;

an annular plate laminated on the first magnet, the annular plate comprising a top surface; and a second magnet of a prescribed thickness that is magnetized in an opposite direction to the first magnet and is laminated on the pole piece, wherein the second maanet extends at least partially above the top surface of the annular plate;

wherein the voice coil is retained in a contactless manner in a magnetic gap formed between the plate, and the pole piece and the second magnet.

* * * * *

UNITED STATES PATENT AND TRADEMARK OFFICE

CERTIFICATE OF CORRECTION

PATENT NO. : 7,068,807 B2
APPLICATION NO. : 10/991337
DATED : June 27, 2006
INVENTOR(S) : Shinji Kobayashi It is certified that error appears in the above-identified patent and that said Letters Patent is hereby corrected as shown below:

Claim 1, col. 6, line 41 should read:
--the second magnet extends at least partially above--

Signed and Sealed this

Fifth Day of September, 2006

JON W. DUDAS
*Director of the United States Patent and Trademark Office*